United States Patent [19]

Hanulik

[11] Patent Number: 4,508,641

[45] Date of Patent: Apr. 2, 1985

[54] PROCESS FOR THE DECONTAMINATION OF STEEL SURFACES AND DISPOSAL OF RADIOACTIVE WASTE

[75] Inventor: Jozef Hanulik, Zurich, Switzerland

[73] Assignee: Gesellschaft zur Förderung der industrieorientierten, Bern, Switzerland

[21] Appl. No.: 412,375

[22] Filed: Aug. 27, 1982

[30] Foreign Application Priority Data

Sep. 1, 1981 [CH] Switzerland ..... 5611/81

[51] Int. Cl.[3] ..... G21F 9/28; C23G 1/08

[52] U.S. Cl. ..... 252/626; 134/3; 134/22.14; 134/22.19; 252/631

[58] Field of Search ..... 252/626, 631; 134/3, 134/22.14, 22.19

[56] References Cited

U.S. PATENT DOCUMENTS 3,873,362 3/1975 Mihram et al. ..... 252/626

4,220,550 9/1980 Frenier et al. ..... 134/40

OTHER PUBLICATIONS

Loucks, C. M., "Cleaning and Defilming Arts in Industry" in Ayres, J. A., *Decontamination of Nuclear Reactors and Equipment,* The Ronald Press Co., N.Y. , (1970), pp. 6–33.

*Primary Examiner*—Deborah L. Kyle

*Attorney, Agent, or Firm*—Watson, Cole, Grindle & Watson

[57] ABSTRACT

A solution is provided for decontaminating steel surfaces, especially in nuclear reactor cooler circuits. The solution contains formic acid and/or acetic acid and at least one reducing agent such as formaldehyde and/or acetaldehyde. The solution is effective to dissolve the iron oxide from the contaminated steel surface directly and/or reductively and to convert it to Fe-(II)-formate or acetate which are stabilized by the reducing conditions in the solution. For waste disposal the dissolved iron is precipitated from the used decontaminating solution, wherein the iron compounds that have been formed are the sole adsorbents for the radioactive materials contained in the decontaminating solution.

16 Claims, No Drawings

PROCESS FOR THE DECONTAMINATION OF STEEL SURFACES AND DISPOSAL OF RADIOACTIVE WASTE

The invention concerns a process for the decontamination of steel surfaces, particularly in nuclear reactor coolant circuits, by the removal of the contaminated surface layer with an acid-containing aqueous decontaminating solution and for the preparation of the decontaminating solution containing the dissolved radioactive materials for waste disposal.

To decontaminate nuclear reactor coolant circuits aqueous solutions of mineral acids are frequently used. Mineral acids are aggressive (corrosive) materials and it is therefore extremely difficult to control the course of the decontamination process by the sole means of adjusting the acid concentration, i.e., such that the contaminated surface layer is effectively removed within an acceptable time while the pure metal of the coolant circuit is not corroded. Corroded spots in the coolant system can lead to leaks which, because of the serious consequences, cannot be permitted.

Consequently, complicated decontamination processes have been developed, one of the best known being the so-called "AP-CITROX" process ("Kernenergie" Volume 11, 1968, p. 285–290). In the first stage of this two-stage process the contaminated metallic surface is prepared in a treatment lasting several hours with an oxidising alkaline permanganate solution. In the second stage dissolution takes place with a reducing aqueous solution of a dibasic ammonium citrate, which also requires several hours. Each stage is followed by flushing with water.

A similar two-stage decontamination process is described in U.S. Pat. No. 3,873,362. In the first process stage, aqueous solutions of alkali metal permanganates, nitric acid, sodium persulphate, sodium bromate an preferably hydrogen peroxide are used for oxidising the contaminated steel surface layer. For the reducing second process stage, aqueous solutions of mixtures of mineral acids, such as sulphuric acid and/or nitric acid and complex-forming materials, such as oxalic acid, citric acid or formic acid are provided, to which corrosion inhibitors, e.g., iron-(III)-sulphate, iron-(III)-nitrate, nitric acid, phenylthiourea or others may be added. The utilization of hydrogen peroxide in the first process stage has, by virtue of its ready decomposition into water and oxygen, the special advantage that the subsequent flushing with water can be dispensed with.

Thereafter, the dissolved metallic components, together with the radioactive materials, are precipitated from the used decontaminating solution of the second process stage. For precipitation the sulphuric and oxalic acid contained in the decontaminating solution can be neutralized with calcium hydroxide so that calcium sulphate and calcium oxalate are formed which contain a great part of the radioactive materials present and which are then separated from the liquid by filtering. Alternatively, potassium permanganate may first by added to the used decontaminating solution in order to decompose the oxalic acid and to obtain manganese dioxide and manganese sulphate, which then can be precipitated by adjustment of the pH value to about 10 with, e.g., calcium hydroxide. Although here also the greater part of the radioactive material is removed with the precipitate, in both cases the filtrate is still contaminated and must be passed to nuclear waste disposal.

Such two-stage decontamination processes may be performed as continuous processes or as batch processes. However, in addition to the long duration, the high consumption of chemicals and water are also unsatisfactory, and above all, in addition to the relatively high amount of solid radioactive waste, liquid radioactive waste is also obtained whereby the waste disposal of the used decontaminating solutions is a difficult problem. With the known processes the decontamination of nuclear reactor coolant circuits is laborious and relatively expensive, especially when corrosion of the pure metallic surfaces is excluded from consideration due to the safety requirements.

Accordingly, the task of the present invention is to provide a decontamination process for nuclear reactor coolant circuits which requires lesser amounts of chemicals and flushing water for the decontamination of steel surfaces of the same area as the known two-stage processes, which permits a preparation of the used decontamination solution in which only minimum amounts of solid radioactive waste materials are present and wherein the liquid waste contains at most a low radioactivity, most likely lying below the permitted threshold value, which enables an easy control of the decontamination process and practically excludes the possibility of corrosion of the pure steel surfaces.

The solution of the task according to the invention consists in the process defined in claim 1.

SUMMARY OF THE INVENTION

In the process according to the invention the decontamination solution contains formic acid and/or acetic acid and a reducing agent, preferably formaldehyde and/or acetaldehyde. These chemicals are not only very cheap but also relatively non-toxic, so that in the handling of this decontaminating solution no special safety measures are required. On contact with the steel surfaces to be decontaminated, $Fe^{2+}$ions go into solution. Accordingly, the decontamination process according to the invention is a single-stage process, which in contrast to a two-stage process assures a gain of time and cost. By means of the reducing agent contained in the decontaminating solution the $Fe^{2+}$ions are held stably in the solution. The liquid is of pale green colour, but is clear and transparent, without cloudiness, and its composition may be relatively easily monitored during the treatment of the steel surface. It has been shown that by such a decontaminating solution ion oxide is removed 10–15 times faster than the pure basic material and this permits the decontamination process to be conducted without great difficulties and in such a manner that an attack on the pure steel surface, which would lead to damaging corrosion by the decontaminating liquid, is practically impossible. For waste disposal iron compounds are precipitated from the decontaminating liquid. Since the used decontaminating solution contains only $Fe^{2+}$ions, no problems arise in precipitation. The deposits that form have the property of adsorbing the radioactive materials in the solution so that by separation of the deposit very high precipitation decontamination factors are achievable. The separated solid deposit contains then practically all the radioactive materials from the decontaminating solution while the liquid contains at most an unimportant residual activity which lies or may lie beneath the tolerance limit, and thus the liquid may be regenerated for re-use or may be subject to a simple chemical waste disposal by decomposition of the dissolved materials into gaseous products and water, NaOH, and possibly $Na_2CO_3$. The chemical composition of the decontaminating solution provided according to the invention permits the $Fe^{2+}$ ions to be precipitated in the form of iron compounds, the density of which roughly corresponds to the density of iron oxide or which can be readily converted into such iron compounds. The radioactive waste obtained by a performed decontamination process is then approximately equal to the material removed from the contaminated surface and thus represents a minimum.

The invention is described in detail purely by way of example in the following:

The task is, for instance, to decontaminate in a continuously running process a nuclear reactor coolant circuit manufactured from a low alloy or stainless steel. The magnitude of the internal surface area as well as the volumetric capacity of the coolant circuit are known.

According to the invention, as decontaminating solution an aqueous solution of formic acid and/or acetic acid and at least one reducing agent are used. Preferred reducing agents are those which are made up of C, H, O, as well as N and do not contain harmful foreign elements such as S. Such reducing agents are, for instance, hydrazine, oxalic acid, ascorbic acid, acetic anhydride, etc., while the decontaminating solution according to the invention preferably contains as reducing agent formaldehyde and/or acetaldehyde.

At the contaminated surface radioactive materials are adsorbed in one layer in a mixture of iron oxides, and by a previous sampling the thickness and composition of the surface layer to be removed may be determined (CH-PS: Application No. 2184/80-7). On the basis of the available and determined data and the given possibilities, such as, in particular, the availability of time, of heating and cooling devices, etc., the expedient composition for the decontaminating solution, the required quantity and the fundamentals of the course of the process are determined.

The oxides of the contaminated steel surfaces are dissolved directly and/or reductively by the decontaminating solution introduced into the coolant circuit and are converted into soluble iron-(II)-formate and/or iron-(II)-acetate which are stabilised by the reducing conditions established in the decontaminating solution principally by the reducing agent present therein, and in particular no oxidation to precipitating ferric compounds takes place. Thus, used decontaminating solution is coloured pale green but is clearly transparent, without turbidity, and contains at most the solid particles of the oxide layer that arise in the dissolution process, which do not represent a disturbing factor either in the decontamination itself or in the treatment of the used decontaminating solution for waste disposal.

A decontamintating solution according to the invention that leads to generally satisfactory results is required to contain, e.g., only formic acid and formaldehyde, wherein for example 1 liter of decontaminating solution contains 7–22 ml formic acid and 12–36 ml formaldehyde.

In the presence of $O^{2-}$ ions, such a decontaminating solution is characterised by the following formulae:

(a) for the reducing agent formic acid $$HCOOH + O^{2-} \rightarrow H_2O + 2e^- \quad (1)$$

and for the reducing agent formaldehyde $$HCHO + O^{2-} \rightarrow HCOOH + 2e^- \quad (2)$$

the dissolution of the contaminated surface layer can be described as:

FeO Dissolution FeO + 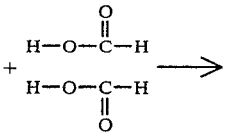 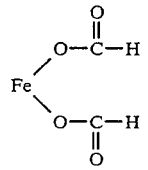 + $H_2O$ (3)

Fe Dissolution $Fe + 2HCOOH \longrightarrow Fe(CO_2H)_2 + H_2$ (4)

Fe (III) Reduction $Fe^{3+} + e^- \longrightarrow Fe^{2+}$ (5)

$Fe_2O_3$ and $Fe_3O_4$ dissolution $Fe^{3+} \longrightarrow Fe^{2+}$; (6)

$FeO \longrightarrow$ direct

One mole of iron reacts with two moles of formic acid and since the molecular weights of the materials used for the decontaminating solution are low (HCOOH: Mol. wt.=46.03, HCOH: Mol. wt.=30.03), and as has been shown experimentally, one liter of decontaminating solution can take up up to 30 g iron in the form of $Fe^{2+}$, and so a relatively low chemicals consumption results for the decontamination while at the same time the cost of formic acid and formaldehyde is low, so that the process according to the invention with such decontaminating solution is particularly economical. This is also true when in place of or additional to the formic acid and formaldehyde acetic acid and acetaldehyde are used in the decontaminating solution, so that the decontaminating solution according to the invention excels by comparison with the known decontamination solutions in general by a low consumption of chemicals and low costs as well as high absorptive capacity for iron.

The used decontaminating solution discharged from the coolant circuit is monitored during the dissolution process whereby the concentrations of $Fe^{2+}$, acid and aldehyde are continuously controlled. Such a control is analytically simple and permits a reliable control of the whole decontamination process whereby an impermissible corrosion of the pure metallic surface is reliably excluded.

The iron compounds contained in the decontaminating solution discharged from the coolant circuit are precipitated out and the used and thus purified decontaminating liquid is re-used, i.e., is regenerated for reintroduction into the coolant circuit. The precipitation of the iron compounds takes place preferably electrolytically, in that the used decontaminating solution is passed through an electrolysis stage which contains an iron cathode and a graphite anode.

At the anode $COOH^-$ ions are oxidized to formic acid or to $CO_2$ and water according to the formula:

$$COOH^- + H^+ \rightarrow HCOOH \quad (7)$$

and at the cathode $Fe^{2+}$ ions are reduced to metallic iron according to the formula:

$$Fe^{2+} + 2e^- \rightarrow Fe^{\circ} \quad (8)$$

The metallic iron adsorbs at least a significant proportion of the radioactive materials contained in the decontamination solution. The decontaminating solution discharged from the electrolysis stage is recycled into the cooling circuit optionally after topping up its formic acid and/or formaldehyde content. In place of electrolytic precipitation, a chemical precipitation of $Fe^{2+}$ may also be provided whereby care must be taken that through the precipitation process no harmful materials, above all no S ions are introduced. In general, therefore, an electrolytic precipitation is preferred.

A further advantage of the decontamination process according to the invention is that on the dissolution of the contaminated surface layer the reactions take place irreversibly and accordingly an entrainment of radioactive materials on surface areas which are not contaminated or are no longer contaminated is not expected to occur.

After the removal of the anticipated thickness of the layer, the decontaminating solution is discharged from the coolant circuit. After the discharge certain residues will always remain in the coolant circuit. In the decontamination process according to the invention, as a consequence of the composition of the decontaminating solution, only such residues are present which may, by means of a simple heat treatment of 175°-300° C., be decomposed thermally into iron oxide and into gaseous decomposition products, particularly CO, $CO_2$ and $H_2O$, i.e., into decomposition products which belong to the coolant circuit and thus have have no harmful influence on the operation. The thermal decomposition of the residue can be undertaken by the introduction of heated air or heated water, but in general is dispensed with because on restarting operation the coolant circuit heats up to the required temperature in a short time. A coolant circuit having residual radioactivity after the decontamination may be rendered "reactor pure" by flushing in the usual manner by means of ion-exchange. Such a flushing should, however, only be required in exceptional cases because the residual activity is easily prevented by corresponding removal of layer thickness.

The discharged used decontaminating solution is further processed for waste disposal. In the decontaminating solution according to the invention the carrier for the discharged radioactive material is the iron that went into the solution and not any other additional material, so that, by precipitation of the iron from the decontaminating solution, practically all the radioactivity is caught in the precipitate and the separated liquid contains at most a permissible amount of radioactivity.

In precipitating for waste disposal the aim is to adsorb all the radioactive materials in the used decontaminating solution in the smallest amount of precipitate, that the precipitate should be readily disposable and that the separated liquid should give rise to the minimum amount of "load" on the environment. In contrast to the precipitation arising in the regeneration of the used decontaminating solution, in precipitation for waste disposal any desired materials such as also sulphur compounds may also be used, provided that with these economically satisfactory precipitation results may be achieved.

The precipitation process that may be considered here is very well described in the literature (e.g. L. Hardinger "Taschenbuch der Abwasserbehandlung", Parts I and II, Karl Hanser-Verlag 1977), so that it is not necessary to go into details. By way of summary the following essentials are here mentioned:

(a) precipitation of $Fe^{2+}$ as FeS with $(NH_4)_2S$ according to $$Fe(CO_2H)_2 + (NH_4)_2S \rightarrow FeS + NH_4(CO_2H), \quad (9)$$

which can be decomposed by heat and/or catalytically to CO, $CO_2$, $H_2O$ and $NH_3$ and water-insoluble iron (II)-sulphide of density 4.6, is precipitated, which has a relatively low molecular weight of 87.9, is well filterable and, for instance in comparison with iron hydroxide, has the advantage of low water content in the filter cake, but which is more difficult in terms of disposal because it for instance is difficult to incorporate into concrete. Additionally, because of the sulphur, this precipitation had better be used only when the separated liquid is to be disposed chemically and is not to be processed for re-use as decontamination solution.

(b) Precipitation of $Fe^{3+}$ and $Fe^{2+}$ as hydroxide according to $$Fe^{2+} + 2OH^- \rightarrow Fe(OH)_2 \quad (10)$$

$$Fe^{3+} + 3OH^- \rightarrow Fe(OH)_3, \quad (11)$$

whereby as precipitation reagent e.g. NaOH may be used.

Precipitation as iron-(II)-hydroxide has the advantage that less NaOH is used but has the disadvantage that the precipitate is somewhat more difficult to filter than iron-(III)-hydroxide. When this is undesired the Fe(II) formate in the used decontaminating solution is first oxidized to Fe-(III)-formate, e.g., with hydrogen peroxide according to $$Fe(CO_2H)_2 \xrightarrow{H_2O_2\ HCOOH} Fe(CO_2H)_3, \quad (12)$$

whereby the iron-(III)-formate is present as the formate of triiron-(III)-hexaformate base $(Fe_3(HCO_2)_6(OH)_2HCO_2).4H_2O$ in the structure

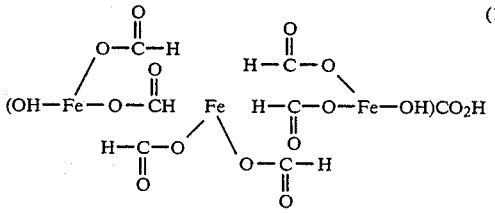

and a ratio of $Fe:(HCO_2)=3:7$ is to be observed. The thus obtained iron-(III)-hydroxide is easier to separate from the liquid, e.g. by filtering as iron-(II)-hydroxide but for precipitation nevertheless requires more precipitating agent than does iron-(II)-hydroxide.

With NaOH as precipitating agent the following reactions arise:

$$Fe(CO_2H)_2 + 2NaOH \rightarrow Fe(OH)_2 + 2NaCOOH \quad (14)$$

and $$Fe(CO_2H)_3+3NaOH \rightarrow Fe(OH_3+3NaCOOH. \quad (15)$$

In the precipitated iron hydroxide at least a very large portion of the radioactive material present in the decontaminating solution is adsorbed and the liquid separated from the precipitate, in the present case an aqueous solution of sodium formate with formaldehyde residues, is not really active or hardly active at all. The sodium formate can then be oxidatively decomposed to NaOH, $Na_2CO_3$, $CO_2$ and $H_2O$.

An advantage of this precipitation process consists in that the weight of the separate precipitate corresponds to that of the material removed by decontamination, i.e., practically no weight increase occurs and also that the precipitate may without further processing readily be disposed by mixing with cement, whereby expediently a ferro-cement-like product is produced and a particularly low yield of contaminated material to be disposed of is assured.

A further advantage of this iron hydroxide precipitation process is the decomposability of the resulting sodium formate. Instead of subjecting the whole mass of used decontaminating solution resulting from the decontamination of a coolant circuit all at once, expediently the decontamating solution is divided into several batches. After an optional treatment with hydrogen peroxide a small amount of precipitating agent, e.g. NaOH, is added to the first batch and after separation of the precipitate, the thus obtained sodium formate is decomposed as described above oxidatively, electrolytically or pyrolytically. The obtained liquid product is then used for precipitating the second batch of decontaminating solution, and so on. Thus, a significantly lower amount of precipitate results and the precipitate to be disposed of the used decontaminating solution can be formed as a recirculatory process or built into a continuous decontamination process as such. It is particularly favourable to proceed in such a way when the liquid separated after the precipitation still contains a certain amount of residual radioactivity because then a corresponding attenuation or dilution of the activity is achieved. The choice of the precipitation process to be used in a given case is determined from the apparatus actually available, from the possibilities of performing the process and particularly also from the volumetric capacity of the coolant circuit and the quantity of material to be decontaminated.

The separation of the deposit precipitate and the liquid can be performed by simple filtering. For easy filtering flocculating agents such as polyacrylamide may be added to the used decontaminating solution whereby the precipitated particles agglomerate into larger particles. As a preferred flocculating agent, the precipitate of a preceding precipitation process is used.

As mentioned, the separated liquid may either be processed for re-use as decontaminating solution, or may be "chemically" disposed of. For chemical disposal the formaldehyde is oxidized to formic acid; and thus obtained formic acid together with the present formic acid is decomposed to $H_2O$ and $CO_2$ by means of an oxidising agent according to the formulae:

$$HCOH+\tfrac{1}{2}O_2 \rightarrow HCOOH \quad (16)$$

and $$HCOOH+\text{Oxisising Agent} \rightarrow H_2O+CO_2 \quad (17)$$

and salts of formic acid are disposed of in the same way.

The thus obtained waste products are harmless to the environment and do not lead to any problems in their disposal. Any desired oxidising agent may be used and a choice thereof is influenced essentially only by the economy, i.e., to the low cost, and attention must be paid to ensuring that the advantageous chemical waste disposal is not affected deleteriously by the oxidising agent.

In the foregoing, the invention was extensively described by reference to a simple decontaminating solution with formic acid and formaldehyde. However, it should be understood without further explanation that the above is also valid for all other desired composition of the decontaminating solution according to the invention.

The decontamination process according to the invention may be carried out as a continuous process with the decontamination solution recirculated in a loop as well as a batch process, the advantages achieved being the same.

It has in particular been shown that contaminated surfaces of low alloy steel as well as stainless steel have been effectively decontaminated by means of the decontamination process according to the invention. Thus, for instance, in a test with stainless steel, the surface of which containing mainly magnetite had an activity of 8 $\mu Ci/cm^2$ had its radioactivity lowered to 0.025 $\mu Ci/cm^2$ by the decontamination process according to the invention, which at a rate of material removal of about 10 $mg/cm^2$ gives rise to a high decontamination factor of 330.

What is claimed is:

1. A process for the decontamination of steel surfaces by removal of the contaminated surface layer with an aqueous decontaminating solution in a recirculation loop and for final treating the used aqueous solution after removal of the surface layer for waste disposal, which process comprises:

(i) in the recirculation loop the steps of:

($a^1$) contacting the steel surfaces with an aqueous decontaminating solution comprising at least one acid selected from the group consisting of formic acid and acetic acid, and at least one reducing agent selected from the group consisting of formaldehyde and acetaldehyde, in a concentration to hold dissolved $Fe^{2+}$-ions stably in the solution;

($b^1$) monitoring the concentration of dissolved $Fe^{2+}$-ions, acid and aldehyde of the decontaminating solution during the dissolution process;

($c^1$) treating the used decontaminating solution to precipitate iron values dissolved therein in the form of iron hydroxide or in the form of water-insoluble iron (III) compounds, and separating precipitated iron compounds from the liquid by filtering; and ($d^1$) treating the aqueous solution remaining after said precipitation to obtain a regenerated decontaminating solution having the desired content of acid and aldehyde, and recircuate it for a new dissolution cycle; and (ii) in the final treatment for waste disposal the steps of:

($e^1$) treating the used decontaminating solution to precipitate iron values dissolved therein in the form of iron hydroxide or in the form of water-insoluble iron (III)-compounds and separating precipitated iron compounds from the liquid by filtering;

($f^1$) decomposing the precipitated iron compounds of steps ($c^1$) and ($e^1$) thermally and/or catalytically into iron oxide-containing radioactive materials-and into radioactivity-free gaseous decomposition products, and subjecting the iron oxide to nuclear waste disposal by mixing it with cement; and ($g^1$) oxidizing the radioactivity-free solution of step ($e^1$) with an oxidizing agent and decomposing therein dissolved formate or acetate salts.

2. A process according to claim 1, wherein before precipitation of the iron in the used decontaminating solution, dissolved iron (II) compounds are oxidized to iron (III) compounds by the addition of an oxidizing agent and are precipitated as water-insoluble iron (III) compounds.

3. A process according to claim 1, wherein, to precipitate iron hydroxide or iron (III) compounds from the used decontaminating solution, alkali metal hydroxide or carbonate is added and after separation of the precipitate from the liquid the alkali metal salt present therein is oxidatively decomposed into alkali metal hydroxide, alkali metal carbonate, carbon dioxide and water.

4. A process according to claim 3, wherein the precipitation of water-insoluble iron compounds from the used decontaminating solution is carried out in a batch process wherein after the precipitation of a first batch of decontaminating solution and the oxidizing treatment of the separated liquid the thus treated liquid is used for precipitation of the iron compounds from a second batch of decontaminating liquid and the process is repeated until all the iron is precipitated from the whole of the decontaminating solution.

5. A process according to claim 1, wherein before filtering the precipitate of a preceding precipitation process is added to the used decontaminating solution as a flocculating agent.

6. A process according to claim 1, wherein the mixing of the precipitate with cement is such that a ferrocement-like product is produced.

7. A process for the decontamination of steel surfaces by removal of the contaminated surface layer with an aqueous decontaminating solution in a recirculation loop and for final treating the aqueous solution after removal of the surface layer for waste disposal, which process comprises:

(i) in the recirculation loop the steps of:

($a^2$) contacting the steel surface with an aqueous decontaminating solution comprising formic acid and formaldehyde as a reducing agent in a concentration to hold dissolved $Fe^{2+}$-ions stably in the solution;

($b^2$) monitoring the concentration of dissolved $Fe^{2+}$-ions, formic acid, and formaldehyde of the decontaminating solution during the dissolution process;

($c^2$) treating the used decontaminating solution by electrolysis to precipitate iron values dissolved in the solution as metallic iron for waste disposal and to oxidize acid-ions to formic acid; and ($d^2$) treating the liquid of the electrolytic process to obtain a regenerated decontaminating solution having the desired content of formic acid and formaldehyde and recirculate it for a new dissolution cycle; and (ii) in the final treatment for waste disposal the steps of:

($e^2$) treating the used decontaminating solution to precipitate iron values dissolved therein in the form of iron hydroxide or in the form of water-insoluble iron (III)-compounds and separating precipitated iron compounds from the liquid by filtering;

($f^2$) decomposing the precipitated iron compounds of steps ($c^2$) and ($e^2$) thermally and/or catalytically into iron oxide—containing radioactive materials—and into radioactivity-free gaseous decomposition products, ($g^2$) oxidizing the radioactivity-free solution of step ($e^1$) with an oxidizing agent and decomposing therein dissolved formate or acetate salts.

8. A process as claimed in claim 7, wherein the electrolysis is conducted with an iron cathode.

9. A process according to claim 7 wherein before precipitation of the iron in the used decontaminating solution, dissolved iron (II) compounds are oxidized to iron (III) compounds by the addition of an oxidizing agent.

10. A process according to claim 7 wherein, to precipitate iron hydroxide or iron (III) compounds from the used decontaminating solution, alkali metal hydroxide or carbonate is added and after separation of the precipitate from the liquid the alkali metal salt present therein is oxidatively decomposed into alkali metal hydroxide, alakali metal carbonate, carbon dioxide and water.

11. A process according to claim 10, wherein the precipitation of water-insoluble iron compounds from the used decontaminating solution is carried out in a batch process wherein after the precipitation of a first batch of decontaminating solution and the oxidizing treatment of the separated liquid the thus treated liquid is used for precipitation of the iron compounds from a second batch of decontaminating liquid and the process is repeated until all the iron is precipitated from the whole of the decontaminating solution.

12. A process according to claim 7, wherein before filtering the precipitate of a preceding precipitation process is added to the used decontaminating solution as a flocculating agent.

13. A process according to claim 7, wherein before the mixing of the precipitate with cement is such that a ferrocement-like product is produced.

14. A process for the decontamination of steel surfaces with an aqueous decontaminating solution and for treating the aqueous solution after decontamination of the surfaces for waste disposal, which process comprises the steps:

($a^3$) contacting the steel surfaces with an aqueous decontaminating solution comprising formic acid and formaldehyde as a reducing agent in a concentration to hold dissolved $Fe^{2+}$-ions stably in the solution;

($b^3$) monitoring the concentration of $Fe^{2+}$-ions, formic acid and formaldehyde of the decontaminating solution during the dissolution process;

($c^3$) treating the used decontaminating solution by electrolysis to precipitate iron values dissolved in the solution as metallic iron—containing radioactive materials—and to decomposite the aqueous solution to gaseous decomposition products; and ($d^3$) treating the precipitated iron for waste disposal.

15. A process according to claim 14, wherein the aqueous decontaminating solution is recirculated in a loop for the treatment of the contaminated steel surfaces, wherein during the removal of the contaminated surface layer the used decontaminating solution is treated by electrolysis to precipitate the dissolved iron and to oxidize acid-ions to formic acid, and liquid of the electrolysis process is regenerated to decontaminating solution having the desired content of formic acid and formaldehyde and is recirculated for a new dissolution cycle.

16. A process according to claim 14, wherein the electrolysis is conducted with an iron cathode.

* * * * *

UNITED STATES PATENT AND TRADEMARK OFFICE

CERTIFICATE OF CORRECTION

PATENT NO. : 4,508,641

DATED : April 2, 1985

INVENTOR(S) : Jozef Hanulik

It is certified that error appears in the above-identified patent and that said Letters Patent is hereby corrected as shown below: On the title page;

[73] Assignee: Gesellschaft zur Förderung der Industrie-orientierten Forschung an den Schweizerischen Hochschulen und weiteren Institutionen Signed and Sealed this Thirtieth Day of July 1985

[SEAL]

*Attest:*

DONALD J. QUIGG

*Attesting Officer* *Acting Commissioner of Patents and Trademarks*